US009410754B2

(12) United States Patent
Gentilini et al.

(10) Patent No.: US 9,410,754 B2
(45) Date of Patent: Aug. 9, 2016

(54) ARM WITH TILTING BARREL GROUP

(71) Applicant: FABBRICA D'ARMI PIETRO BERETTA S.p.A., Gardone Val Trompia, Brescia (IT)

(72) Inventors: Claudio Gentilini, Brescia (IT); Massimiliano Longa, Brescia (IT)

(73) Assignee: FABBRICA D'ARMI PIETRO BERETTA S.p.A., Brescia (IT)

( * ) Notice: Subject to any disclaimer, the term of this patent is extended or adjusted under 35 U.S.C. 154(b) by 0 days.

(21) Appl. No.: 14/114,385

(22) PCT Filed: Nov. 23, 2012

(86) PCT No.: PCT/IB2012/056683

§ 371 (c)(1),
(2) Date: Oct. 28, 2013

(87) PCT Pub. No.: WO2013/128248

PCT Pub. Date: Sep. 6, 2013

(65) Prior Publication Data

US 2015/0020424 A1 Jan. 22, 2015

(30) Foreign Application Priority Data

Feb. 29, 2012 (IT) ..... BS2012A0029

(51) Int. Cl.
*F41A 3/60* (2006.01)
*F41A 3/58* (2006.01)
*F41C 7/11* (2006.01)

(52) U.S. Cl.
CPC ... *F41A 3/58* (2013.01); *F41A 3/60* (2013.01); *F41C 7/11* (2013.01)

(58) Field of Classification Search
CPC ..... F41A 3/58; F41A 3/60; F41C 7/11
USPC ..... 42/4, 45, 75.044, 75.04, 44
See application file for complete search history.

(56) References Cited

U.S. PATENT DOCUMENTS

| | | | | | |
|---|---|---|---|---|---|
| 93,149 | A | * | 7/1869 | Whitney | 42/46 |
| 161,559 | A | * | 3/1875 | Scott | 42/44 |
| 248,249 | A | * | 10/1881 | Baker | 42/44 |
| 395,849 | A | * | 1/1889 | Parry | 42/44 |
| 399,214 | A | * | 3/1889 | Smith | 42/41 |
| 3,636,646 | A | | 1/1972 | Drevet | |

FOREIGN PATENT DOCUMENTS

| | | | |
|---|---|---|---|
| FR | 2934363 | A3 | 1/2010 |
| WO | 2006/046094 | A1 | 5/2006 |

* cited by examiner

*Primary Examiner* — Reginald Tillman, Jr.
(74) *Attorney, Agent, or Firm* — Meunier Carlin & Curfman LLC

(57) ABSTRACT

An arm (1) comprises a main body (5), a tilting barrel group (2) fitted to the main body (5) and a locking device (10). The locking device (10) is acting between the main body (5) and the barrel group (2) and manually operable between a locked position, in which the tilting of the barrel group (2) is prevented, and a release position, in which the barrel group (2) is released from said body (5). Said locking device (10) comprises at least one sliding bolt (20) or plug, partially housed in the main body (5) so that, in the locked position, a portion thereof engages the barrel group (2). The device is further comprising a safety catch element (100), acting between the barrel group (2) and the main body (5), which acts in conjunction with the bolt (20) to maintain the locked position.

10 Claims, 11 Drawing Sheets

ARM WITH TILTING BARREL GROUP

The present invention relates to an arm with tilting barrel group having a locking device suitable for preventing tilting of the barrel.

Devices or systems for locking arms with tilting barrels are known of.

Such systems have the purpose of allowing or preventing the user from tilting the barrel of the arm in relation to the body of the rifle. Typically said systems are positioned inside the arm except for a portion which projects outwards so that it can be operated by the user.

Among the devices typical of the prior art are the bolt moved longitudinally, the plug moved transversally and the longitudinally moving plug.

Said devices can be moved by the user using a key to place them in an open or closed position, such as to permit or block the tilting of the barrel group and thereby permit the extraction of the cases as opposed to the reloading of new cartridges.

However the known devices shown above have a series of drawbacks which have not yet been resolved.

In particular, sometimes the systems of the aforesaid type do not carry out a safe and reliable closure, that is to say irreversible, of the firing chamber with the risk that the arm could undesirably open after firing; in addition such systems often prove excessively stiff during opening of the arm, which is therefore not very easy.

In fact, both on account of their geometrics and of the forces, involved, the prior devices always have a certain degree of reversibility, that is to say a tendency to open after firing, and therefore unreliability, thereby running the risk of accidental opening occurring. Specifically, in the state of the art such closure systems must permit the best interaction with the tilting barrel group thereby performing their task.

In other words, said systems, during firing, are subject, on account of the geometry of the arm, for example as a result of the taper needed to ensure a perfect coupling of the parts, to a force tending to cause a reversibility of the closure.

In addition, the search for as solid interaction as possible, and therefore of a reliable closure, causes an undesirable degree of complexity in the movement of the locking devices. Such requirements are clearly antithetic to each other to the point where in the devices of the prior art a compromise has had to be reached. For example, in the prior art in order to ensure a certain degree of interaction between the aforesaid components avoiding as far as possible said difficulties of opening and closing, specifically due mainly to friction phenomena, such as "slip stick", it is customary to design the various components with one or more inclined and/or conical surfaces.

The compromise typical of the prior systems consists precisely in the degree of inclination of said surfaces; in fact to ensure a good seal of the lock it is desirable for said inclination to be relatively low, but to facilitate the user and make the movement easier, thereby avoiding friction phenomena, such as "slip stick", the angle of the inclined planes must necessarily be increased.

A compromise is therefore preferred in the design of the locking devices, in other words, an angle of inclination which favours interaction, limiting as far as possible the risk of accidental opening, while making the movement of the means responsible for movement "smooth" or delicate. As in all compromises, neither of the aforesaid purposes is really satisfied.

The purpose of the present invention is to make an arm comprising a locking device suitable for performing a solid and reliable closing, free of clearance and therefore irreversible, avoiding any accidental and unwanted opening of the barrel group; all while making its handling simpler and more comfortable.

Such purpose is achieved by an arm according to claim 1.

The characteristics and advantages of the locking device will be evident from the description given below, made by way of a non-limiting example, with reference to the attached drawings, wherein:

FIG. 1 is a side view of an arm, in particular a rifle with overlaid barrels, with tilting barrels, comprising a locking device, according to a preferred embodiment;

FIG. 1*a* is an upper view of the arm shown in FIG. 1 and in particular of the part of the arm which the locking device is located in;

FIG. 2 is a perspective view of a preferred embodiment of the locking device comprised in the arm which the invention relates to;

Figure 1:
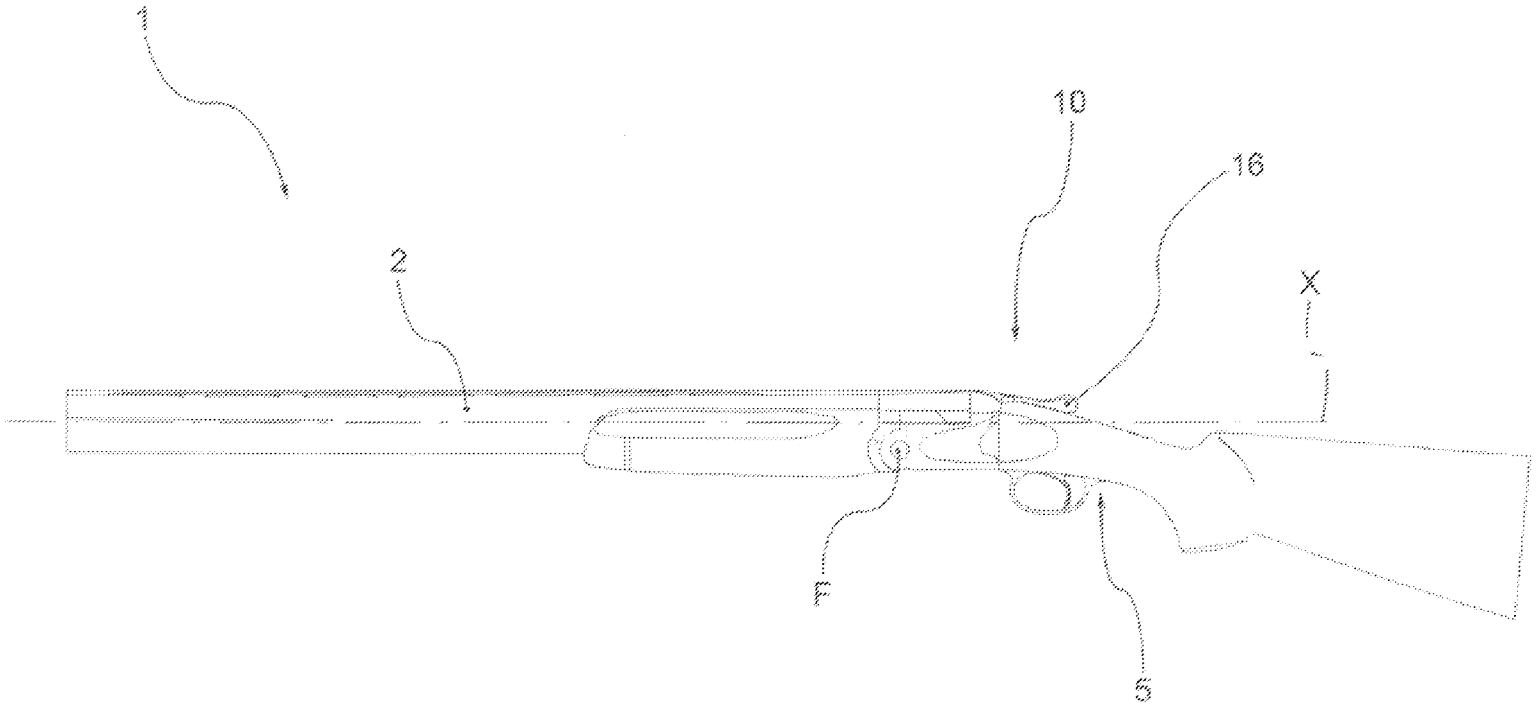
Figure 1A:
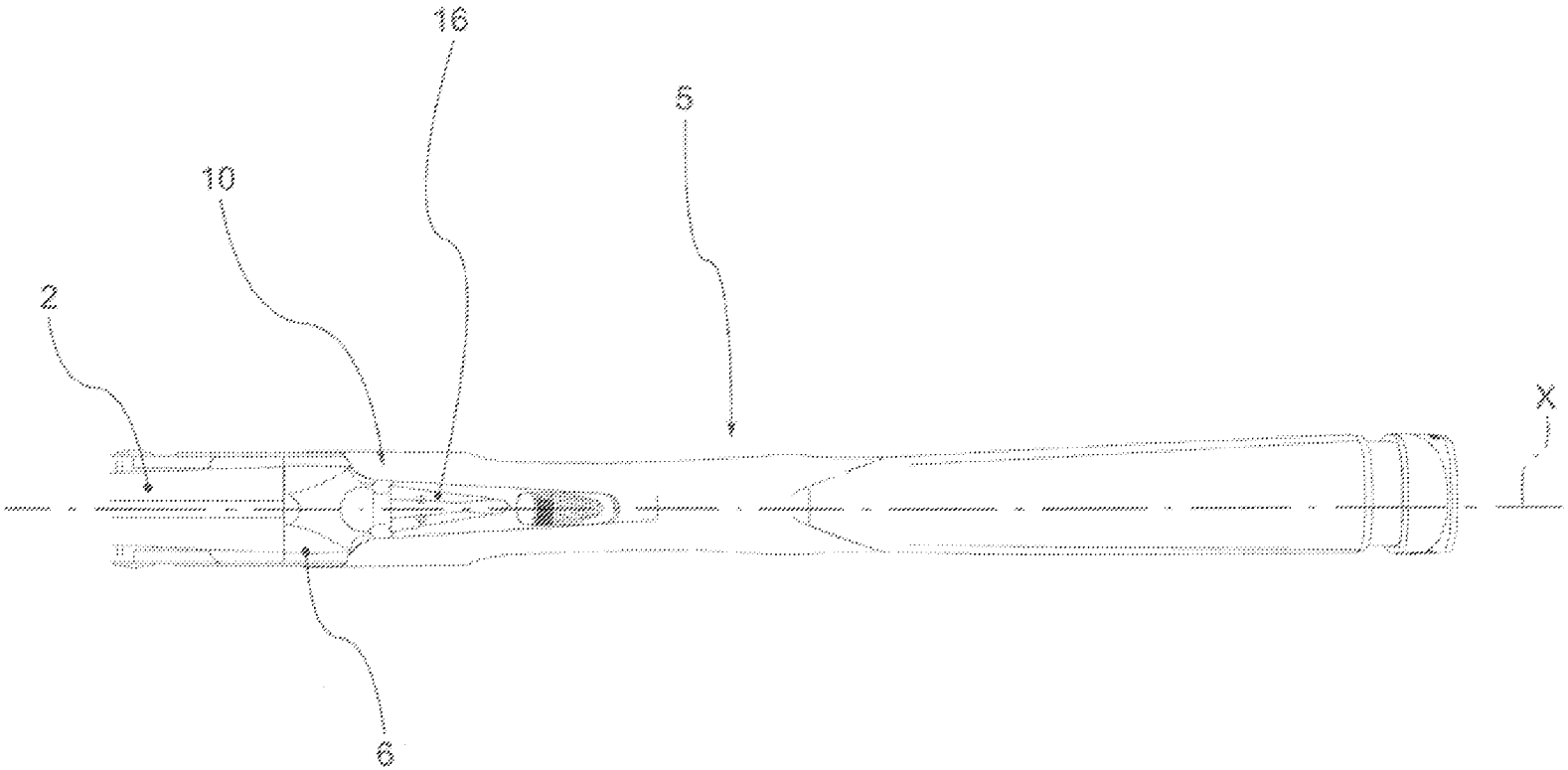
Figure 2:
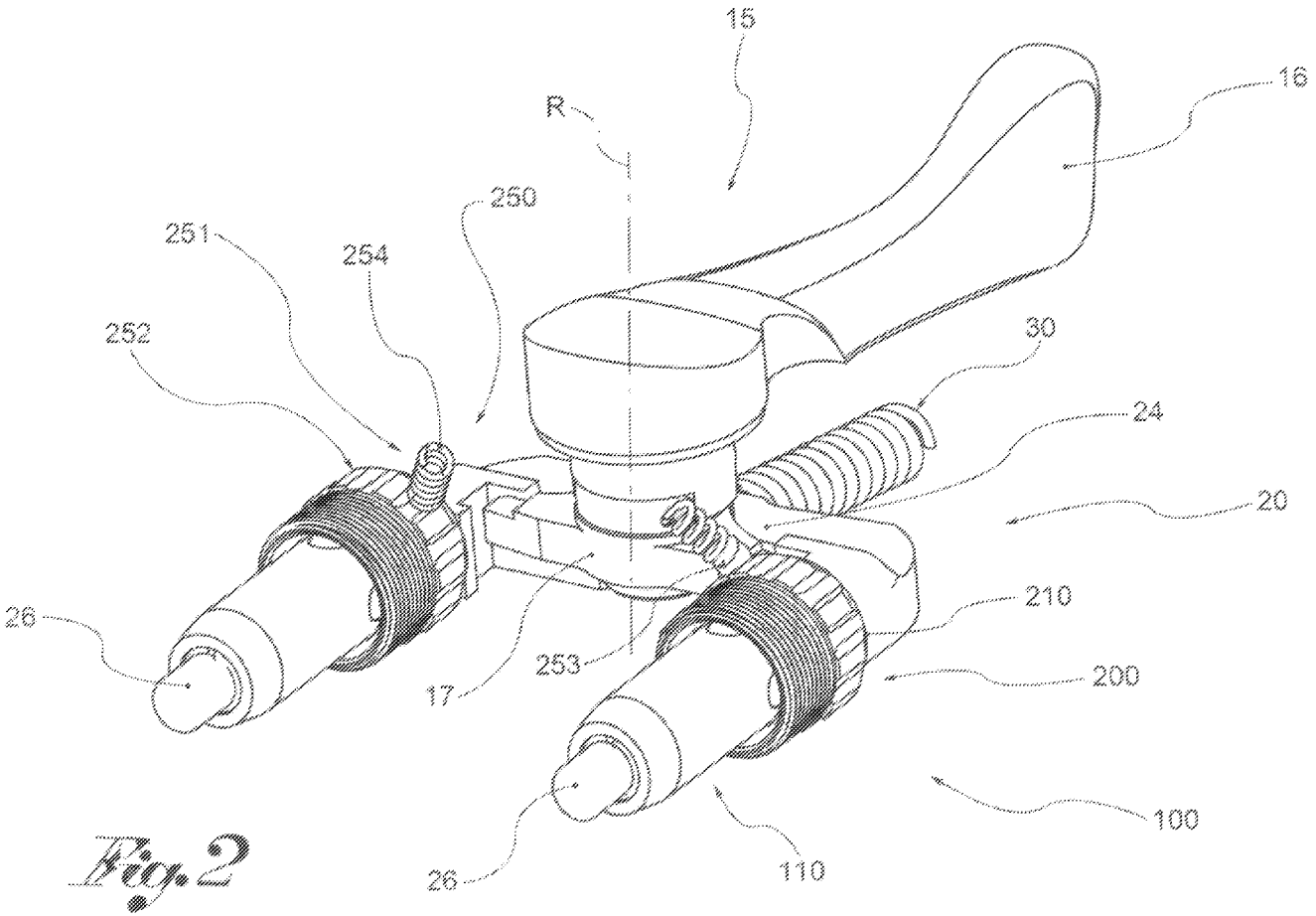
Figure 3:
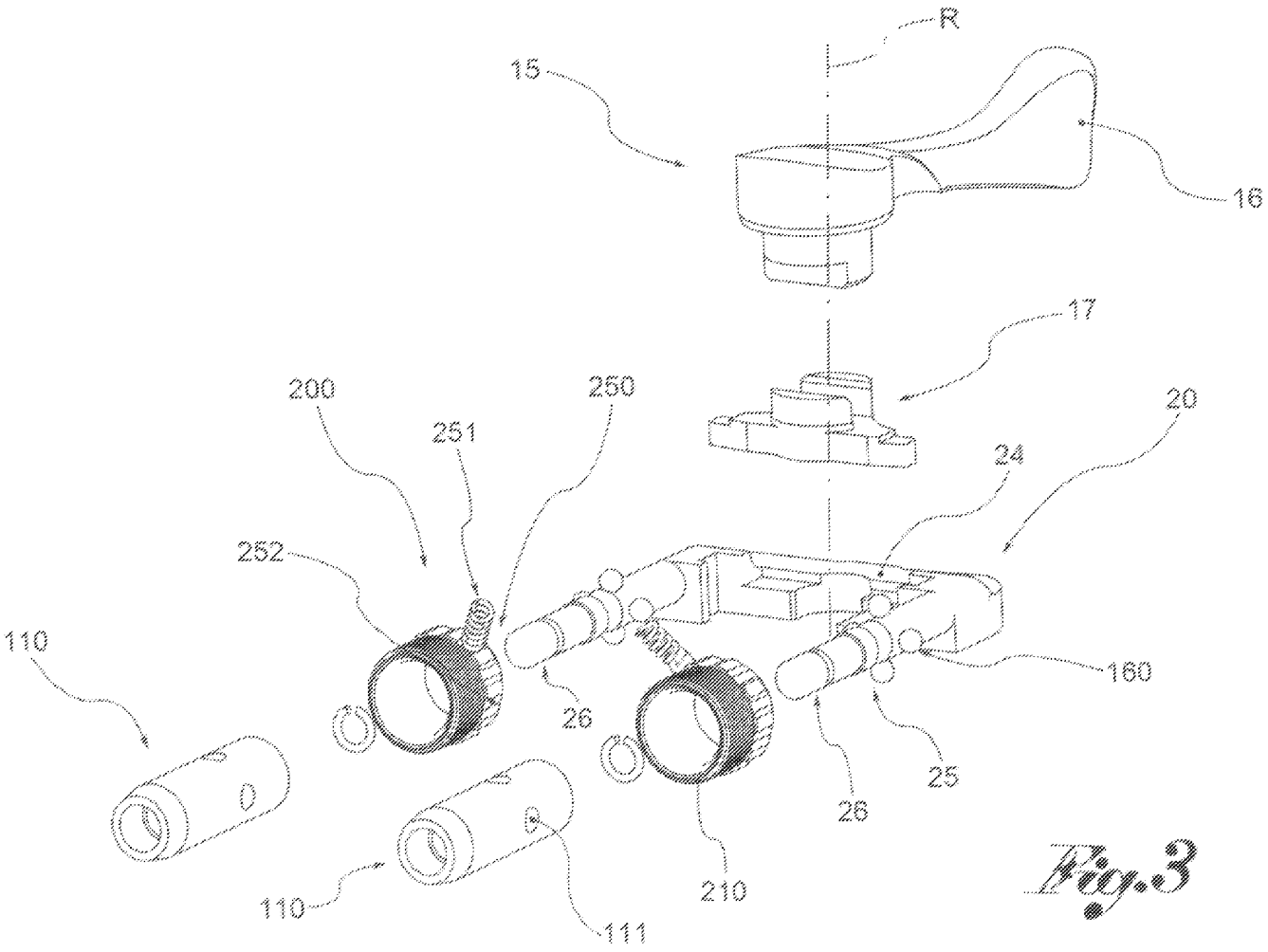
FIG. 3 is an exploded perspective view of the embodiment of the locking device shown in FIG. 2.
Figure 1A:
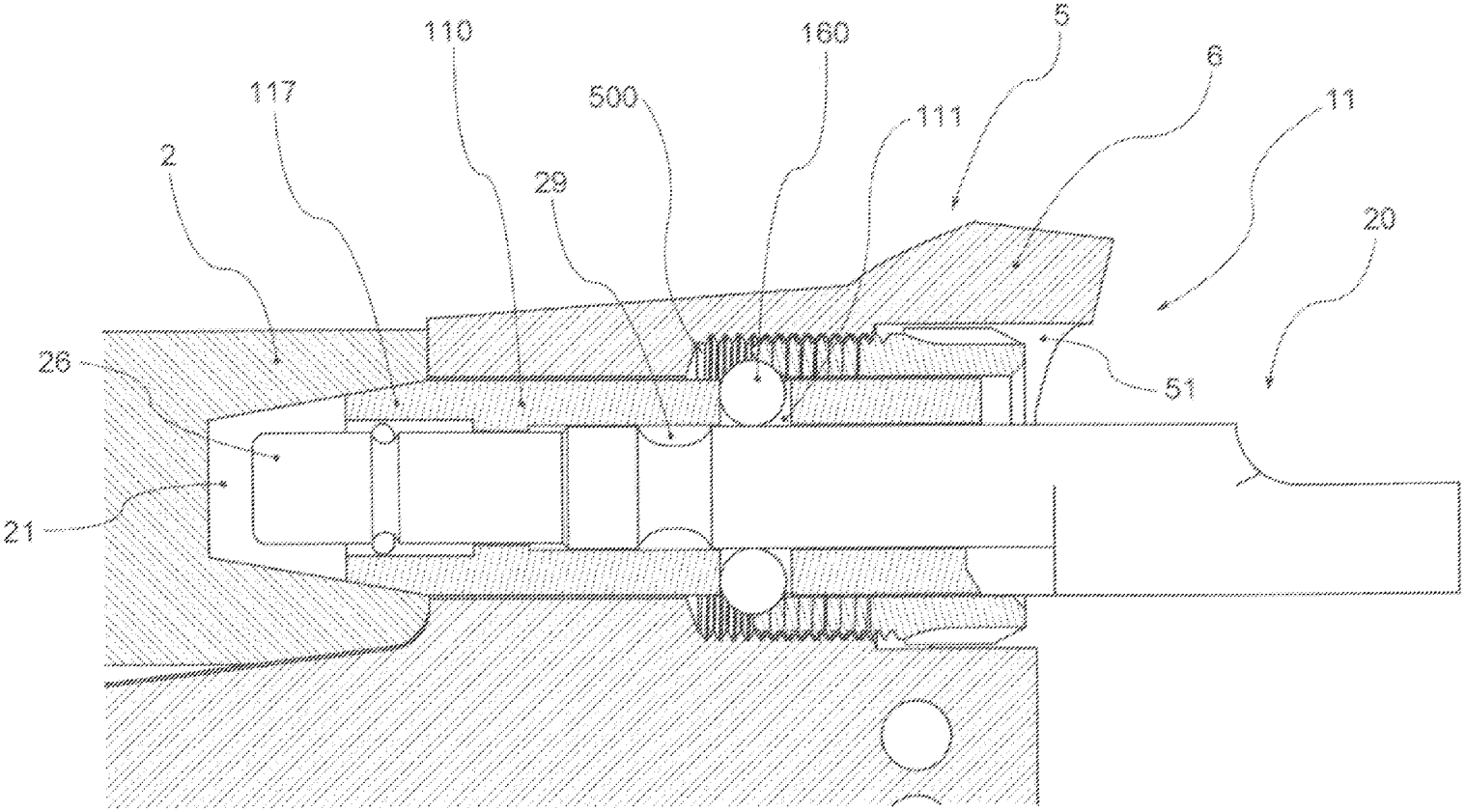
Figure 4B:
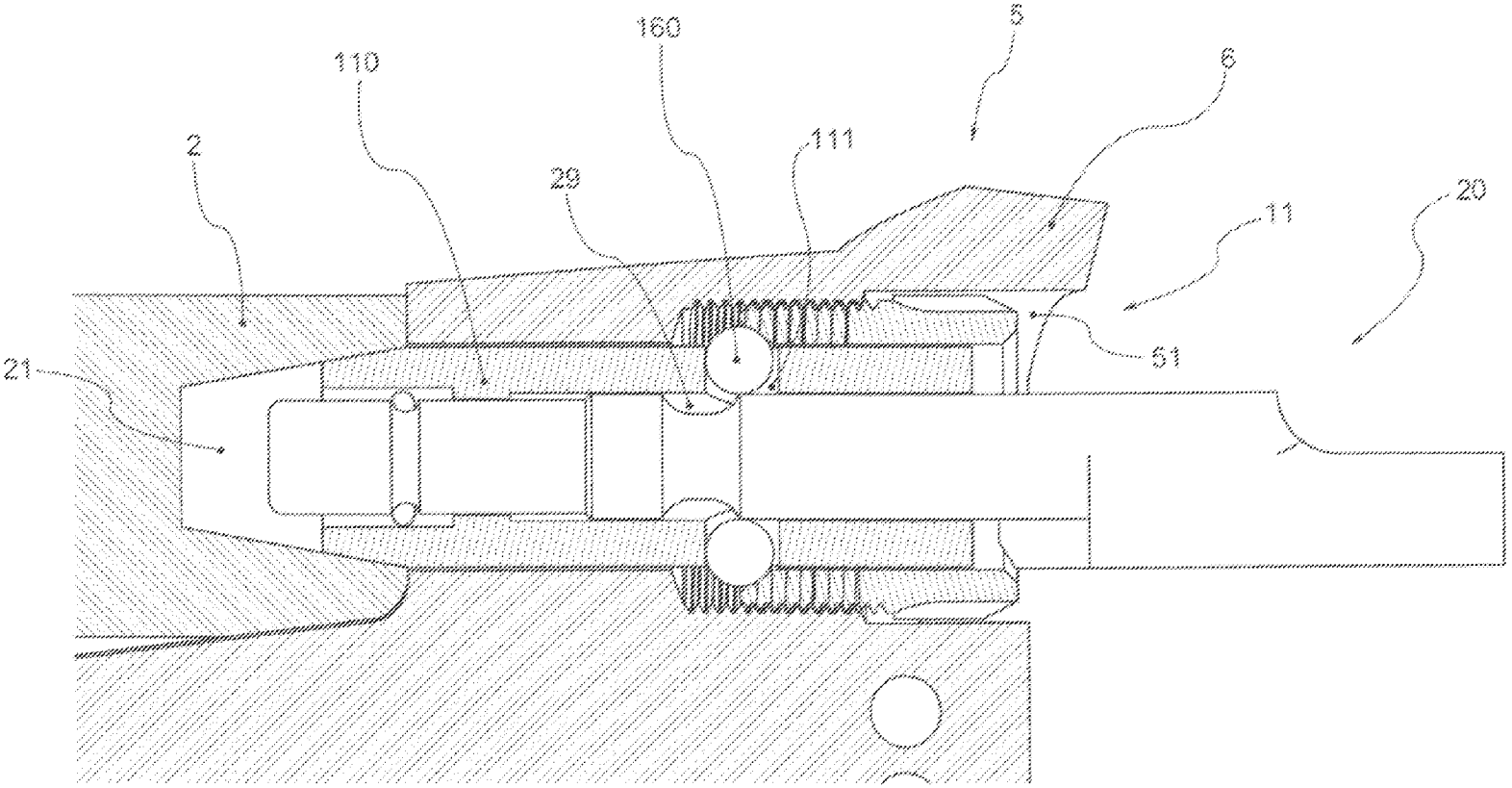
Figure 1C:
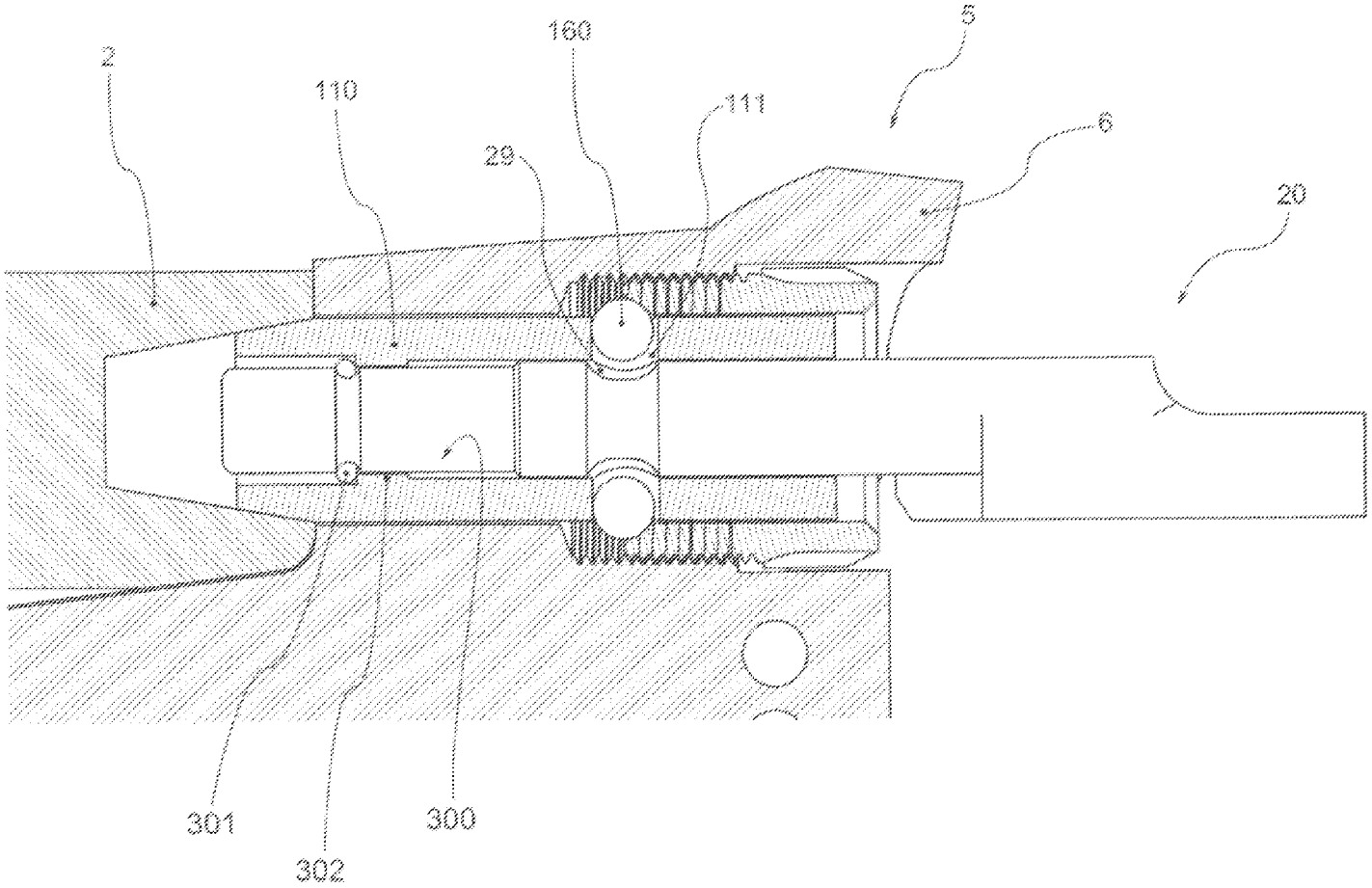
Figure 1D:
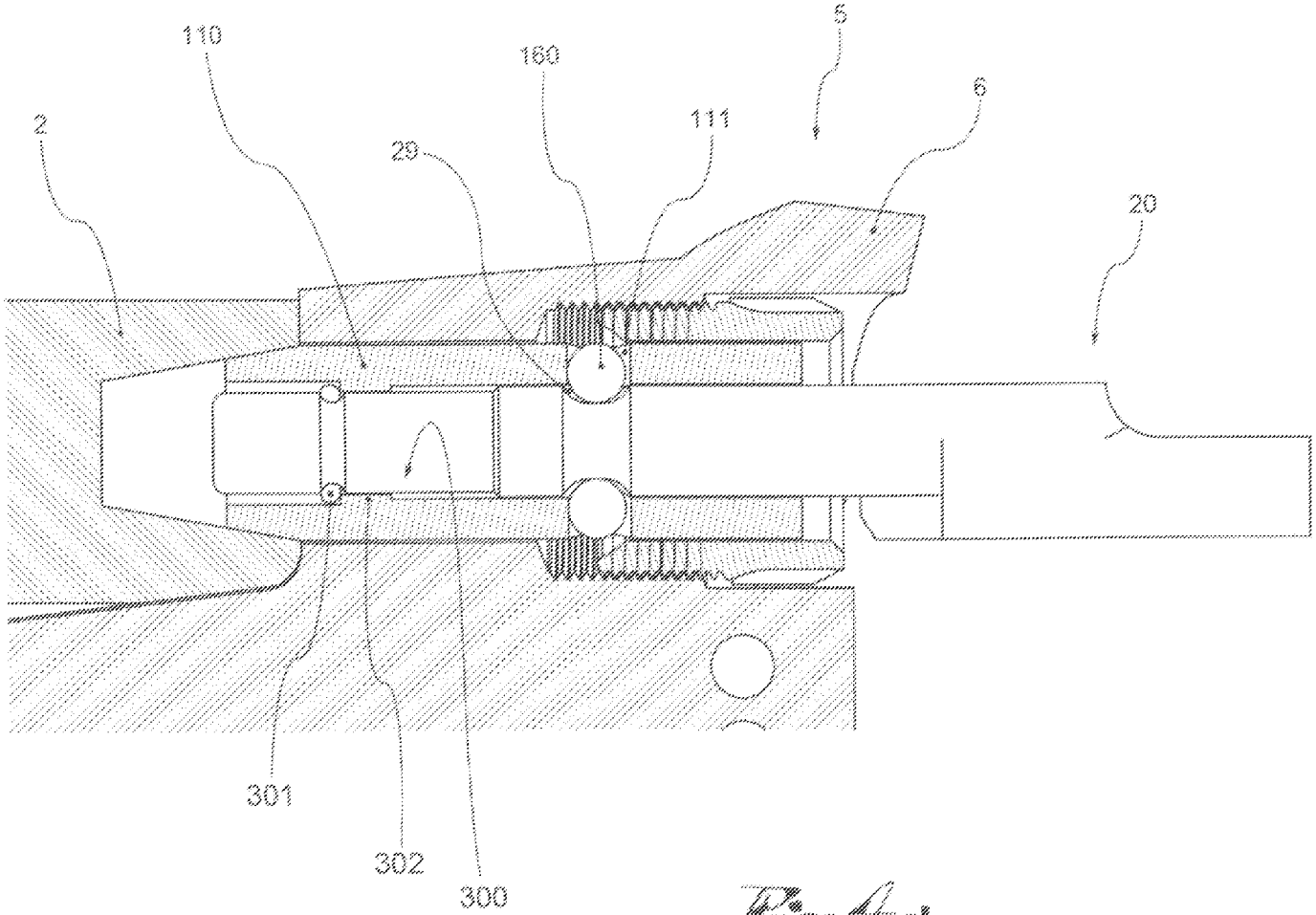
Figure 4E:
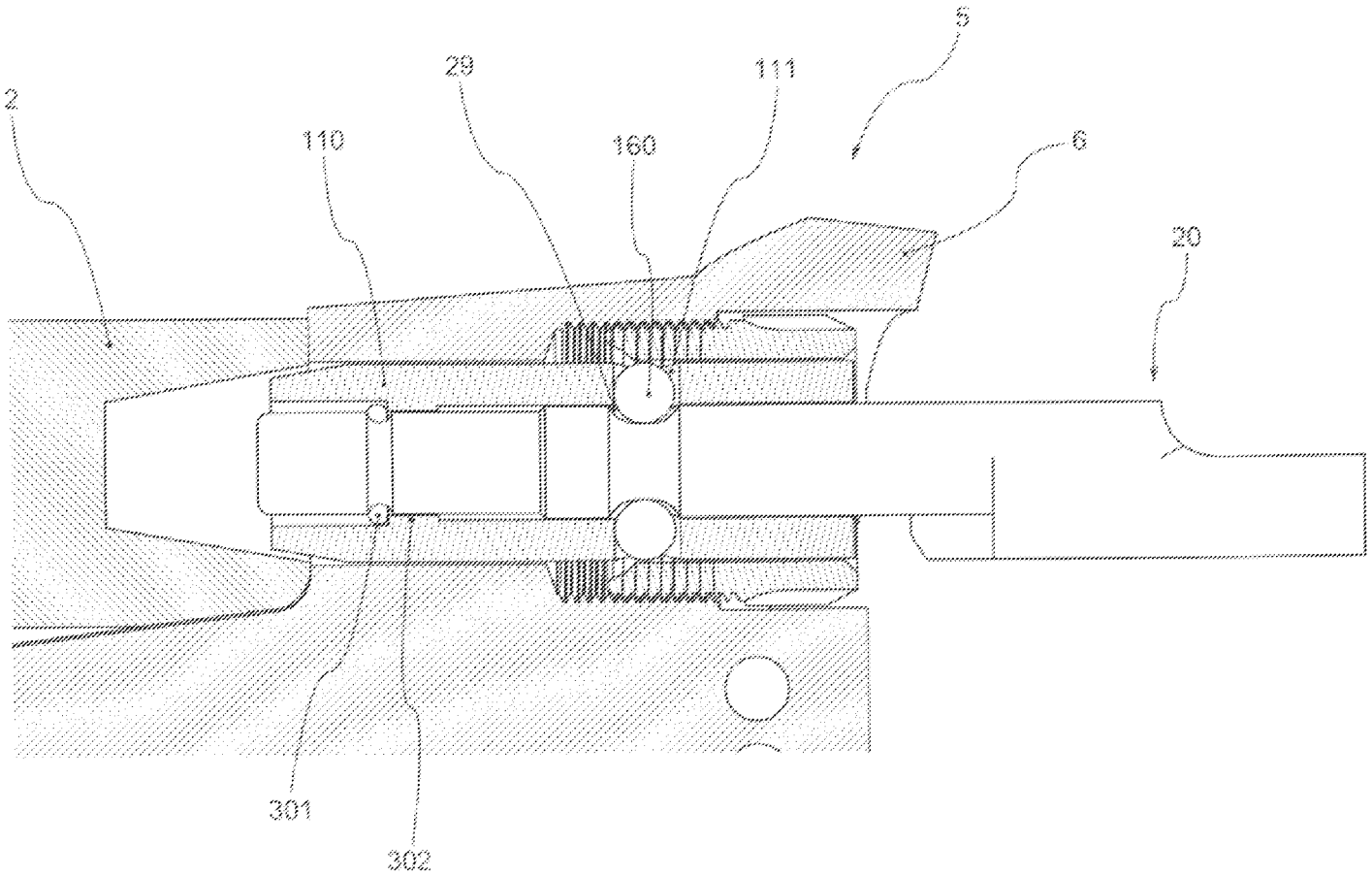
Figure 4F:
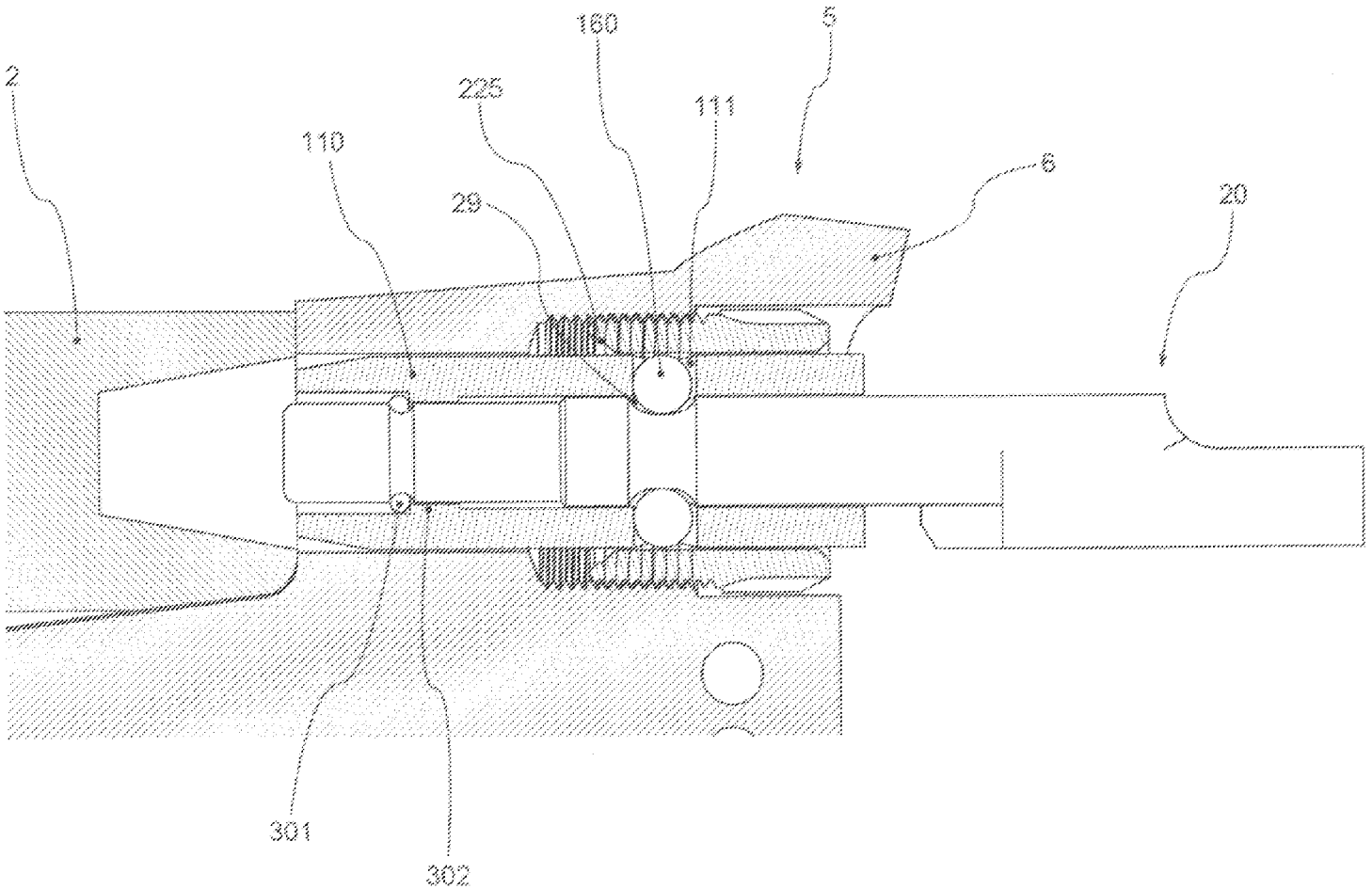
Figure 5:
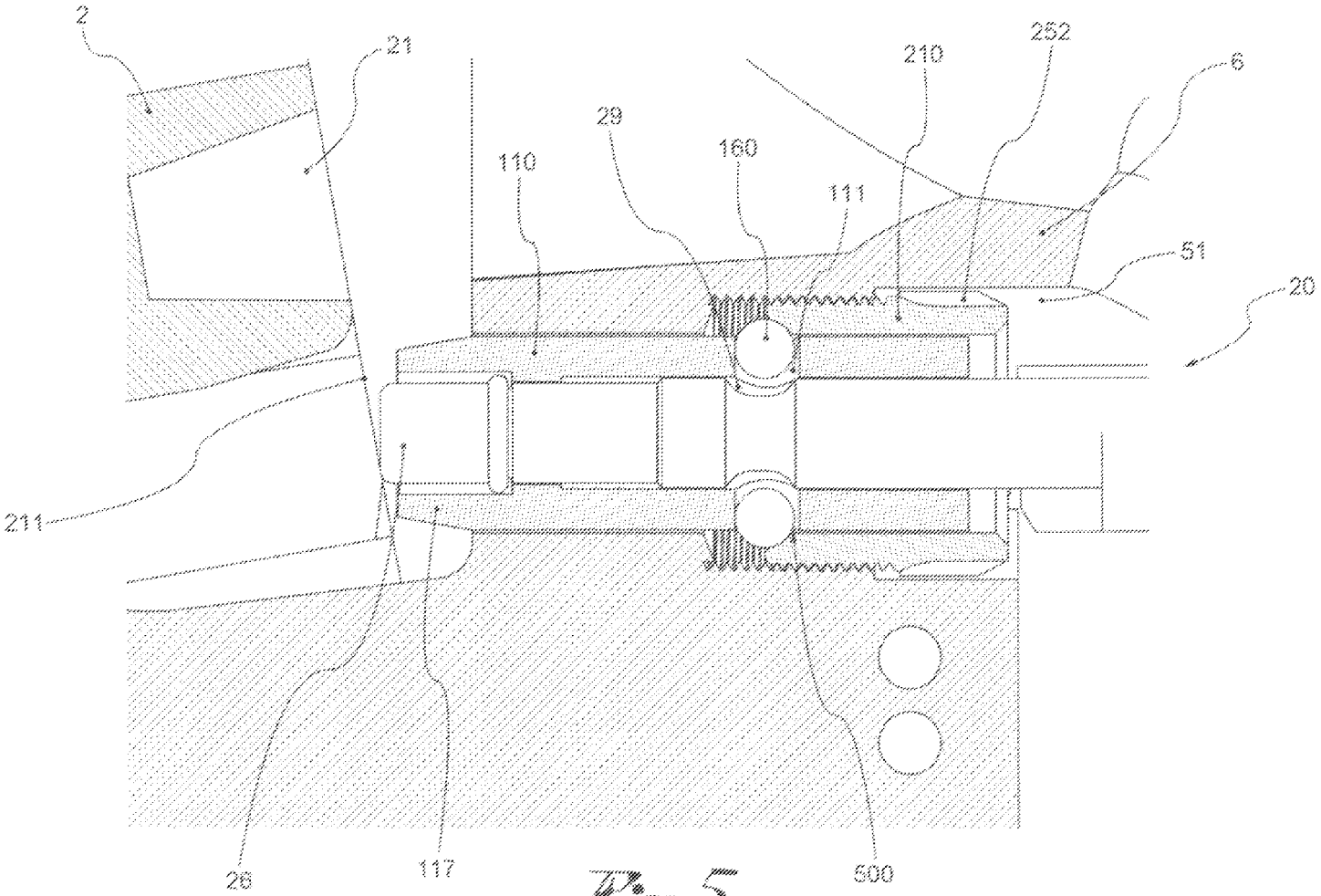

FIGS. 4*a*, 4*b*, 4*c*, 4*d*, 4*e* and 4*f* are cross-sections of part of the arm which the present invention relates to, showing the locking device in FIG. 2, fitted inside it, in turn in cross-section; in particular respectively showing a locked position (FIG. 4*a*), a first rearward bolt position (FIG. 4*b*), a second rearward bolt position (FIG. 4*c*), a position of co-operation bolt-safety catch component (FIG. 4*d*), a first rearward bolt-safety catch component position (FIG. 4*e*) and a second rearward bolt-safety catch component or release position (FIG. 4*f*);

FIG. 5 shows a cross-section of a part of the closure device shown in FIG. 2 fitted inside the arm in an anomalous situation, that is to say wherein the barrel group is in the released position and the device is in the locked position.

With reference to the appended drawings, reference numeral 1 globally denotes an arm in its entirety, preferably a rifle; reference numeral 10 denotes rather a locking device, suitable for preventing the barrel group from moving, in particular from tilting.

The arm 1 comprises a main body 5 and a barrel group 2, fitted to the main body 5 so as to tilt. In other words, the main body F identifies a fulcrum F around which the barrel group 2 is hinged.

Preferably, the barrel group 2 comprises a least one barrel, for example a single barrel, or a plurality thereof, for example overlaid (as shown in the appended drawings) or alongside as in a double barrel; the barrel group 2 extends along a barrel axis X-X.

According to further embodiments the arm is for sports or hunting.

Specifically, the main body 5 comprises a firing device with at least one trigger fitted in a moveable manner (for example rotatable or translatable) on the main body, and a hammer which can be operated by means of such trigger acting on the firing pin).

Moreover, preferably, the main body 5 comprises a rocker 6 which supports and houses the firing device.

In a preferred embodiment, the locking device 10 is substantially inside the arm 1 and is manually operable. Specifically, the locking device 10 acts between the main body 5 and the barrel group 2; in particular this is manoeuvrable between a locked position, in which tilting is prevented, and a released position, in which the barrel group 2 is released from said body 5.

In a preferred embodiment, the locking device 10 comprises a plug or bolt 20 at least partially housed inside the arm 1.

Preferably, the bolt 20 is housed so as to slide in the arm 1, in a substantially longitudinal direction, that is to say parallel to a barrel axis X. In particular, the locking device 10 (and, advantageously, such bolt 20) acts between the main body 5 and the barrel group 2, being manually operable between the locked position (for example shown in FIG. 4) and the release position (for example shown in FIG. 4*f*) so that a rotation of the first in relation to the second is feasible.

Specifically, the bolt 20 can be moved by the user by means of the control means 15 in such a way as to be translatable as mentioned above, so that such control means 15 and the bolt 20 are functionally connected, for example by means of the transmission components described below.

In a preferred embodiment, the bolt 20 slides in the main body 5 (for example in the rocker 6), comprising a portion, for example, an end portion 26, which engages the barrel group 2 in the locked position. Preferably, in fact, inside the arm 1 a housing 11 is made suitable for containing at least a part of the locking device 10 and in particular at least part of the bolt 20.

In particular, a part of the housing 11 is made in the body 5 while the other part is made in the barrel group 2, respectively in the body-housing portion 51 and in the barrel-housing portion 21.

Specifically, the locking device 10 is suitable for acting in conjunction with the body 5 and with the barrel group 2 depending on the relative positions in said housing 11 and thereby in said body 51 and barrel-housing 21.

In a preferred embodiment, the body-housing 51 is created in the rocker 6.

In a preferred embodiment, the bolt 20 comprises a control portion 24, suitable for being manoeuvrable, a central portion 25 and an end portion 26; the central portion 25 and the end portion 26 extend for a certain length of said command portion 24. Preferably, the control means 15, specifically a transmission organ 17, act on the control portion 24, so as to move the bolt 20 as described subsequently.

In a preferred embodiment, the control portion 24 is located in the body, preferably in the rocker 6, while the central portion 25 and the end portion 26 extend, in the aforesaid locked position, inside the housing 11, in the body 5 and in the barrel group 2, in particular from the body-housing 51 to the barrel-housing 21. Preferably, the bolt 20, in particular the central portion 25 or the end portion 26 is an elongated shape along said direction of extension, for example a prismatic, cylindrical, tapered or truncated cone shape. In the locked position, the end portion 26 is housed in the barrel-housing 21; following movement of the bolt 20 by the user using the control means 15, the end portion 26 is suitable for being moved, for example translated, in such a way as to be received in the body-housing 51, thereby leaving the barrel group 2 free to move.

In a preferred embodiment, the bolt 20 comprises several projections suitable for interacting with the barrel group, comprising therefore, starting from the control portion 24 several central portions 25 from which several end portions 26 extend.

In a preferred embodiment, the bolt comprises at least two projections, and therefore at least two central portions 25 and end portions 26. In other words, the bolt 20 has an overall U r C shape. Preferably, each portion has different dimensions and measurements from the other.

Preferably, the action carried out by the user on the bolt 20, in particular on the control portion 24, using the control means 15, is equally transmitted to the various portions comprised in the bolt 20.

In other words, when the control means 15 are moved, so that the bolt 20 in turn is moved from one position to another, preferably longitudinally, the portions comprised therein also perform such movement. Specifically, such movement entails a movement from the locked position, in which the barrel group 2 is blocked to the main body 5, preferably to the rocker 6, to the released position, in which the barrel group 2 is free to tilt in relation to the main body 5.

In a preferred embodiment, the bolt 2 is preferably made in one piece.

In a preferred embodiment, the control means 15 comprise a key 16, preferably external to the arm 1, so as to be operable by a user.

Preferably, the key 16 is suitable for rotating around its rotation axis R-R; said rotation axis R-R is for example incident to the longitudinal axis X-X, preferably substantially perpendicular thereto.

Moreover, in a preferred embodiment, the control means 15 comprise at least one transmission element 17 to transmit the rotary movement of the key 16 into translatory movement of the bolt 20. Preferably, the transmission element 17, for example extends radially in relation to the rotation axis R-R.

In a preferred embodiment, the transmission element 17 acts on the control portion 24. Preferably, a rotation of the transmission element 17 corresponds to a longitudinal movement forward or backwards of the bolt 20 specifically, into the locked or open positions of the locking device 10.

In other words, the rotation axis R-R is positioned between the control portion 24 and the barrel group 2 in such a way that with a movement of the control means 15, that is a rotation of the key 16 and consequently of the transmission element 17, the control portion 24 and consequently the entire bolt 20, distances itself from the barrel group 2.

That is to say, the locking device 10 moves from the locked position to the released position, and vice versa.

Preferably, the transmission element 17 acts on the bolt 20 and in particular on its control portion 24, so that if moved with the same angle of rotation in both directions of rotation around the rotation axis R-R, it acts on the bolt 20 in the same way causing the same movement thereof.

That is to say that the key 16 can be moved in one direction or the other, thereby proving suitable for use by left-handed and right-handed users. That is to say that the locking device 10 is suitable for being operated ambidextrously.

In a preferred embodiment, an elastic element 30 comprised in the locking device 10 acts on the bolt 20; in particular, the elastic element acts so as to keep the bolt in the locked position over time, and in particular when no movement is applied to the control means 15.

Preferably, the elastic element 30 acts as a thrust on the bolt 20.

In one embodiment variation, the elastic element 30 acts in traction on the bolt 20. The movement of the control means 15 must therefore overcome the force of said elastic element 30 to distance the bolt 20 from the barrel group 2.

In a preferred embodiment, said elastic element is a spring, for example a coil spring.

In a preferred embodiment, the locking device 10 comprises a safety catch element 100 suitable for maintaining the locked position.

Moreover, in a preferred embodiment, the safety catch element 100 acts between the barrel group and the main body 5, preferably the rocker 6.

Preferably, the safety catch element 100 acts in parallel with the bolt 20.

In a preferred embodiment, the safety catch element 100 is placed between the main body 5, preferably between the rocker 6, and the bolt 20 so that, in the locked position, said safety catch element 100 discharges at least some of the firing force on the main body 5.

That is to say that the safety catch element 100, in the locked position, in which the arm 1 is utilisable and the shots are therefore firable, absorbs, at least in part, the forces which the arm 1 undergoes when a shot is fired; specifically the forces caused by firing which tend to make the arm 1 rotate and thereby tend to cause an unwanted and undesirable tilting of the barrel group 2 in relation to the body 5.

The safety catch element 100 is therefore suitable to absorb, and discharge on the main body 5, preferably on the rocker 6, said firing force which by tending to make the barrel group 2 tilt would tend to influence the bolt 20.

In particular, the safety catch element 100 prevents said firing forces from influencing the bolt 20 and making it translate from the locked position to the released position, thereby facilitating a possible opening and tilting of the barrel group 2.

In a preferred embodiment, the safety catch element 100 is movable between a forward position in which the barrel group 2 is locked, and a rearward position in which the barrel group is free to tilt.

Preferably, the safety, catch element 100 is translatable, for example parallel to the barrel axis X-X.

In addition, the safety catch element 100 is movable/translatable parallel to the bolt 20.

In a preferred embodiment, the safety catch element 100 is movable/translatable by means of the bolt 20.

Preferably, the safety catch element 100 comprises a safety catch component 110 which at least partially houses the bolt 20 in a translatable manner.

In particular, said safety catch element 100 is suitable for being fitted on the bolt 20 and in particular in the central portion 25 thereof.

Preferably, identifying a proximal zone indicatively along the barrel axis X-X at the grip of the arm and a distal zone at the muzzle of the arm 1, the safety catch component 110 tapers distally, that is to say towards the distal zone.

In a preferred embodiment, the safety catch component 110 is a peg shape. Preferably, the safety catch component 110 is a substantially cylindrical shape and extends along and around the respective portion of bolt 20. Specifically, it extends around the bolt 20 substantially in its length, from the control portion 24 to the end portion 26.

Preferably, the safety catch component 110 has a through cavity in which the bolt 20 is housed and in which the bolt 20 is slidingly translatable.

In particular, the safety catch component 110, in its distal tapering, comprises a tip 117 suitable for coming into contact with the barrel group 2, in particular with the barrel housing 21, specifically, with the inner surface delimiting said barrel housing 21.

In the locked position in fact the safety catch component 110 is in contact with the barrel group 2 and specifically is positioned internally to the barrel housing 21. In other words, the safety catch component is in contact with the barrel group without clearance of any type.

Thanks to this interaction the blocking of the tilting of the barrel group 2 in relation to the main body 5 is ensured by the locking device 10.

In a preferred embodiment, the barrel housing 2 and the safety catch component 110, preferably the tip 117, have a shaped coupling. Preferably, both components have inclined or conical surfaces so as to facilitate said interaction and said blocking preventing the presence of clearance between the parts. In a preferred embodiment, the safety catch element 100 also comprises at least one roller or ball 160 which, in the forward position, acts between the safety catch component 110 and the main body 5.

In addition, as described above, the roller or ball 160 is specifically suitable for acting between the safety catch component 110 and main body 5, but equally between the bolt 20 and safety catch component 110.

Said at least one roller or ball 160 is suitable for inserting itself in a space 500 identified by the bolt 20 and by the safety catch component 110.

In particular, the roller or ball 160 is suitable for permitting the substantially simultaneous rearward movement of the bolt 20 and the safety catch component 110.

Specifically, the space 500 is made by means of a through hole or slot 111 passing through the safety catch component 110. Moreover, the space 500 is preferably made by means of a localised cavity on the bolt 20, in particular, in its outer surface, on the central portion 25.

In a preferred embodiment, the safety catch element 100 comprises adjustment means 200 acting in conjunction with the main body 5 and with the safety catch component 110 so as to permit axial adjustments of the latter in relation to the main body 5 and/or the barrel group 2.

Preferably, the adjustment means 200 act on the safety catch component 110 by means of the roller or ball 160.

Specifically, said adjustment means 200 comprise a ring-nut 210 fitted coaxially to the bolt 20 and/or to the safety catch component 110.

In a preferred embodiment, in fact, the ring-nut 210 can be screwed to the main body 5; this way it is the user who positions it axially as needed, screwing it in one predefined position as opposed to another.

Specifically, clearance and any wear caused by use of the locking device 10 can thus be recovered by means of such adjustment.

In one embodiment, the ring-nut 210 has a toroidal cavity 225, internally facing the safety catch component 110, suitable for contacting at least one roller or ball 160 in such a way as to act in conjunction with it, defining its position laterally and radially.

Preferably, during its relative movement, the at least one roller or ball 160 placed in axial movement is limited in said axial movement by the toroidal cavity 225, which acts axially as an obstruction; moreover, the toroidal cavity is suitable for axially guiding the at least one roller or ball 160 in such a way as to position it in the space 500. Depending on the position of the bolt 20 chosen by the user, the toroidal cavity 225, the through hole or slot 111 and the cavity 29 have different reciprocal positions.

In addition, preferably, the adjustment means 200 comprise anti-rotational elements 250 suitable for preventing an accidental and undesirable loosening of the ring nut 210.

The anti-rotational elements 250 are, in fact, suitable for maintaining over time, once positioned, the position of the ring-nut 210 chosen by the user.

In a preferred embodiment, the anti-rotational elements 250 comprise a resilient element 251 acting between the main body 5 and the ring-nut 210 for example radially.

In particular, the resilient element 251 is suitable for interacting with the ring-nut and specifically on a jagged profile 252 present on the outside thereof.

In the rotation of the ring-nut 210 the force interacting between the ring-nut 210 and resilient element 251 must therefore be overcome so that the resilient element 251 passes from one valley to another of the jagged profile 252.

In particular, the resilient element 251 comprises a ball 253 and a spring 254 so that when the ring-nut 210 is placed in rotation, said ball 253 is pushed by the spring 254 into the valleys of said jagged profile 252.

This way, to unscrew the ring-nut 210 the force impressed on it by the spring 254 by means of the ball 253 must be overcome.

As a result the ball 253 subjected to the force impressed by the spring 254, snaps into position, following rotation of the ring-nut 210, from one groove or valley to the adjacent one.

With reference to the appended drawings from FIG. 4*a* to FIG. 4*f* the functioning of the locking device 10 and the various positions adopted by the components during such positioning, starting from the locked position as far as the release position, is described below. In the locked position, shown for example in FIG. 4*a*, the barrel group 2 is locked to the main body 5 and the arm 1 is in the firing position. In such position, the bolt 20, for example pushed by the elastic element 30, is positioned in a forward manner, that is to say is positioned in the locked position; specifically, the bolt 20 is as far forward as possible and with it the safety catch component 110 is positioned as far forward as possible. The safety catch component 110 has the tip 117 in contact, and interacting with the barrel group 2 so as to lock and prevent the relative rotation between the barrel group 2 and main body 5. In the locked position the at least one ball or roller 160 is housed in the slot 111 offset from the cavity 29; in addition, in the locked position the roller or ball 160 is suitable for contacting the toroidal cavity 225.

In particular, the ring-nut 210 is adjustable in such a way that the locking position has such configuration; in said configuration a continuity is formed between the various components so that any forces on the safety catch component 110 are transmitted by the roller or ball 160 to the ring-nut itself and thereby to the main body 5, preferably to the rocker 6, which it is screwed to.

Using the control means 15 the user moves the bolt 20, in particular translating it away from the barrel group 2; in particular the bolt 20 is moved parallel to the barrel axis X-X from a distal to a proximal position.

As shown in FIG. 4*b*, the locking device 10 positions itself in a rearward bolt position in which the only element translating is, in effect, the bolt 20; in particular, following such movement, using the control means 15, on the control portion 24 of the bolt, the end portion 26 and central portion 25 are moved, translating.

There is no interaction between the bolt 20 and safety catch component 110; in this step the safety catch component 110 maintains its position.

By means of said movement the cavity 29 on the bolt 20 is brought closer to the roller or ball 160, housed in the slot 111, limited in movement by the toroidal surface. When the cavity 29 and roller or ball 160 and in particular the slot 111 are radially aligned, a second rearward bolt position is defined, shown in FIG. 4*c*.

Once said configuration has been assumed, in which the cavity 29 and slot 111 are aligned, the roller or ball 160 is suitable for positioning itself in the cavity 29.

In particular, starting from said configuration the bolt 20 and safety catch component are suitable for reciprocally acting in conjunction so as to move backwards (and similarly, subsequently advance) simultaneously.

Specifically, said movement is due to the fact that the bolt 20 and safety catch element 110 have interaction means 300, preferably bolt interaction means 301 and safety catch component interaction means 302 respectively made on the bolt 20 and on the safety catch component 110.

In a preferred embodiment, said interaction elements 300 are projecting elements, teeth, protrusions, annular or circular rings which are suitable to geometrically interfere with each other.

In particular, the interaction means 300 reciprocally interact so that when a component is made to move, translate, it drags with it, for example for a certain distance, the other component; in other words, during the movement of the bolt 20 by the interaction means 300, these also move the safety catch component 110.

In a preferred embodiment, the interaction means 300 are made directly on the components in one piece with them or again are obtained by abutment means such as for example a ring, Seeger or the like.

The interaction means 300 are designed so that the bolt 20 is suitable for translating, for a certain distance, freely, until the hole or slot 111 aligns with the cavity 29.

In particular, following the alignment of the roller or ball 160 and cavity 29, said roller or ball 160 positions itself inside said cavity 29 since, continuing the movement, the safety catch component 110 tends to move backwards and the roller or ball 160 in abutment with the ring-nut 210 is pushed by said ring-nut 210, and in particular by the toroidal cavity 225, inside the cavity 29.

The various components thereby position themselves in a first bolt-safety catch co-operation position. Once in the bolt-safety catch co-operation position, continuing the rearward movement of the bolt 20, the roller or ball 160 interacts with the safety catch component 110 no longer having any interference with the ring-nut 210. This way, continuing with the rearward movement of the bolt 20, the safety catch component 110 is also moved backwards at the same time, by means of the roller or ball 160 now in position and/or by the interaction means 300. As shown in FIG. 4*e*, the locking device 10 positions itself in a rearward bolt-safety catch component position in which both the bolt 20 and the safety catch component 110 are distanced from the barrel group 2 coming out of the barrel-housing and positioning themselves in the body-housing 51. The rearward movement of the locking device 10 continues as far as the release position, shown in FIG. 4*f*. In said position no component of the locking device 10 is in the barrel housing 21, in this way the barrel group 2 is free to tilt and therefore to be opened.

The closing of the barrel group 2 and of the locking device 10 follows the same steps illustrated above for its release, in reverse.

An anomalous position is in addition envisaged, that is to say the possibility that the barrel group is rotated and "tilted" while the locking device 10 is in the locked position. In the case in which the user should try to close the barrel group 2 onto the main body 5, the locking device 10 has been designed to prevent problems of interference between the various components.

Specifically, the bolt 20 has been designed so as to project from the safety catch component 110. In fact, the end portion 26 projects in relation to the tip 117 in such a way that in said anomalous situation the barrel group tilting in relation to the main body 5 interacts in the first place with the end portion 26. Specifically, a contact wall 211 is identified in the barrel group 2 as the wall in which the entrance mouth of the cartridges is located, as well as the wall on which the barrel housing 21 is made. When, in such anomalous situation, the barrel group 2 is rotated, tilting towards the main body, said contact wall 211 interacts with the tip 26 and continuing said rotation pushes it towards a rearward position.

During said operation and said translation the hole 111 and the cavity 29 align, the ball 160 enters said cavity 29 so as to permit without obstruction the rearward movement also of the safety catch component 110 and the closure of the barrel group 2 on the main body 5.

Innovatively, the locking device which the present invention relates to proves to have a safe and reliable locked position. Positioned in the locked position in fact, the locking device which the present invention relates to maintains said position, preventing any type of unwanted opening, such as for example opening caused by firing forces.

Advantageously, the forces present during firing are absorbed by the safety catch element, in particular by a roller or ball comprised in the safety means. This, in abutment with the ring-nut, discharges thereon all the forces involved. The forces absorbed are thereby discharged by the ring-nut to the main body; this way, the bolt does not move backwards, and no unwanted opening is therefore caused, as occurs rather in the prior art.

Advantageously, in other words, the forces involved, caused by the firing action, and in particular to their longitudinal component, with a direction going from the barrel group to the main body, act directly on a safety catch component and in no way on the bolt. Since said forces do not act on the bolt, this remains stationery, and any accidental opening proves impossible.

Moreover, advantageously thanks to the locking device which the present invention relates to no compromise need be reached in achieving closure or locking between as safe a condition as possible and a "smooth" or easy opening.

Advantageously, in fact in the locking device these two phenomena are separate from each other.

Advantageously, in the locked position, the locking device comprises a locking element which does not influence the bolt, thereby achieving a safe locked position in which any forces, for example due to firing, are discharged onto the arm and not onto the bolt.

Advantageously by means of the locking device which the present invention relates to, closing and opening are related only to the force of the elastic element which can therefore be calibrated so that said movements are "smooth".

Advantageously, the structural simplicity of the control means and kinematic chain they form allows simple and intuitive opening of the locking device, in a "smooth" and ergonomic manner.

Advantageously in addition, opening is equally possible for a left-handed or right-handed user.

Advantageously by making the locking device with components machined in tolerance even the assembly thereof proves easy and intuitive.

Advantageously the locking device is adjustable during installation, this way any clearance or tolerances for example acting on the ring-nut can be recovered. Advantageously even during the life of the arm, any wear or malfunctioning can be recovered by recalibrating, screwing or unscrewing the ring-nut as needed.

This way the life of the locking device, estimated as unlimited, can be prolonged.

Advantageously, anti-unscrewing mechanisms are present to prevent the ring-nut from moving out of the position set by the user.

Advantageously in the blocked position the key comprised in the control means and positioned externally to the arm is always aligned with the barrel axis X-X of the arm; in fact, as said, the recovery of clearance, tolerance and wear is performed inside the device, on the ring-nut/s, not influencing the appearance of the arm.

Advantageously, the embodiment described and shown in the appended figures also presents significant aesthetic qualities, valorising the arm; in particular, said aesthetic qualities are due precisely to the structural design characteristics of the device and in particular to the fact that clearance, tolerance and wear are recovered inside the arm and not externally, for example by varying the initial position of the key.

Advantageously, as described, the locking device is further suitable to function but above all not to undergo damage, even in the case of attempted anomalous closure. In fact, even in an anomalous situation such as that described previously and illustrated in FIG. 5, the locking device acts so that it is possible to restore it to a locked position without damaging it or the arm.

Advantageously the locking device is not limited to a single type of arm or tilting barrels in that its functioning principle is adaptable to the situation as needed, proving highly versatile.

A person skilled in the art may make variations to the embodiments of the locking device described above or replace elements with others functionally equivalent so as to satisfy specific requirements.

For example, in a preferred embodiment, the shape of the bolt, and in particular the number of central and end portions, may be varied or positioned differently from the embodiments shown, for example depending on the type of barrel.

Or again, the movement of the locking device and/or safety catch element may be obtained in a different manner from the substantially longitudinal movement shown.

Again, the locking device shown in the appended drawings, is typical of the bolt embodiment, however it may be just as well used in a plug embodiment.

In yet a further embodiment, in order to ensure the correct interactions between the various components, the interaction element comprises several balls or rollers acting on the same bolt, preferably on the same central portion thereof.

In one embodiment, in fact a multiple number of angularly equidistant balls are used.

In particular, in a preferred embodiment variation, each safety element comprises four angularly equidistant balls suitable for operating with the bolt and with the ring-nut as described above.

Such variations are also contained within the sphere of protection as defined by the following claims. Moreover, each of the variants described as belonging to a possible embodiment may be realised independently of the other variants described.

The invention claimed is:

1. An arm comprising:

a main body;

a barrel group, which extends mainly along a barrel axis and which is fitted in a pivoting manner in relation to the main body; and a locking device, acting between the main body and the barrel group and operable manually between a locked position, in which the pivoting of the barrel group is substantially prevented, and a release position, in which the barrel group is pivotally released from said body;

wherein the locking device comprises:

i) at least one bolt or a plug, partially housed in the main body so as to slide and comprising a portion, which in the locked position engages the barrel group;

ii) a safety catch element, acting between the barrel group and the main body, which acts in conjunction with the bolt to maintain the locked position; and iii) at least one roller or ball which, in a forward position, acts between the safety catch component and the main body;

wherein the safety catch element comprises a safety catch component which at least partially houses the bolt in a translatable manner.

2. An arm according to claim 1, wherein the at least one roller or ball is suitable for inserting itself in a space identified by the bolt and by the safety catch component to permit their substantially simultaneous rearward movement.

3. An arm according to claim 2, wherein the space is made by means of a hole or through slot through the safety catch component.

4. An arm according to claim 2, wherein the space is obtained by means of a cavity located on the outer surface of the bolt.

5. An arm according to claim 1, wherein the safety catch element comprises adjustment means acting in conjunction with the main body and with the safety catch component so as to permit axial adjustments of the latter in relation to the main body and/or the barrel group.

6. An arm according to claim 5, wherein the adjustment means act on the safety catch component by means of the at least one ball or roller.

7. An arm according to claim 5, wherein the adjustment means comprise a ring-nut fitted coaxially to the bolt and/or to the safety catch component.

8. An arm according to claim 7, wherein the ring-nut can be screwed to the main body.

9. An arm according to claim 8, wherein the adjustment means comprise anti-rotational elements suitable for preventing an accidental loosening of the ring nut.

10. An arm according to claim 9, wherein the anti-rotational elements comprise a resilient element acting between the main body and the ring-nut, which acts, on a jagged profile of the ring-nut.

* * * * *